US005220236A

United States Patent [19]

Washburn et al.

[11] Patent Number: 5,220,236

[45] Date of Patent: Jun. 15, 1993

[54] GEOMETRY ENHANCED OPTICAL OUTPUT FOR RF EXCITED FLUORESCENT LIGHTS

[75] Inventors: Robert D. Washburn, Malibu; Robert F. McClanahan, Valencia; David A. Head, Torrance, all of Calif.

[73] Assignee: Hughes Aircraft Company, Los Angeles, Calif.

[21] Appl. No.: 649,390

[22] Filed: Feb. 1, 1991

[51] Int. Cl.[5] ..... H01J 61/067; H01J 61/34; H01J 61/42

[52] U.S. Cl. ..... 313/26; 313/489; 313/493; 313/607; 313/634

[58] Field of Search ..... 313/493, 607, 26, 634, 313/489

[56] References Cited

U.S. PATENT DOCUMENTS

| | | | |
|---|---|---|---|
| 2,009,375 | 7/1935 | Ford | 313/634 X |
| 2,413,940 | 1/1947 | Bickford, Jr. | 313/26 |
| 2,433,404 | 12/1947 | Smith | 313/26 |
| 3,521,120 | 7/1970 | Anderson | 313/493 X |
| 4,240,010 | 12/1980 | Buhrer | 313/493 X |
| 4,837,484 | 6/1989 | Eliasson et al. | 313/607 X |
| 4,983,881 | 1/1991 | Eliasson et al. | 313/493 X |
| 5,013,959 | 5/1991 | Kogelschatz | 313/607 X |

*Primary Examiner*—Palmer C. Demeo
*Attorney, Agent, or Firm*—L. A. Alkov; W. K. Denson-Low

[57] ABSTRACT

A fluorescent lighting structure having an inner glass envelope and an outer glass envelope surrounding the inner glass envelope, an ionizable gas contained within the volume between the inner and outer glass envelopes, an electrode structure disposed on the inside surface of the inner glass envelope, a phosphor coating disposed on the outside surface of the inner glass envelope, and an ultraviolet reflective coating on the inside surface of the outer glass envelope. Excitation of the electrode structure causes discharge of the ionizable gas that produces ultraviolet radiation, which in turn excites the phosphor coating to emit visible light.

4 Claims, 2 Drawing Sheets

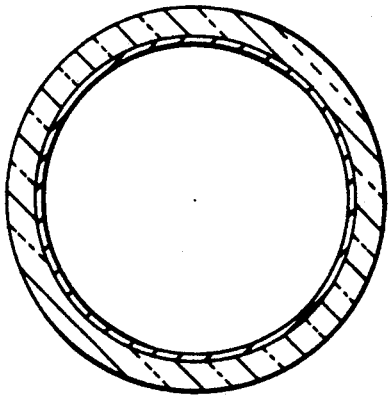
FIG. 1 PRIOR ART
FIG. 2
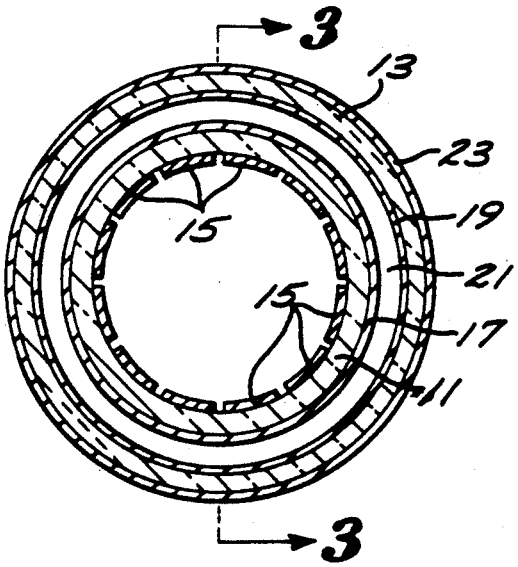
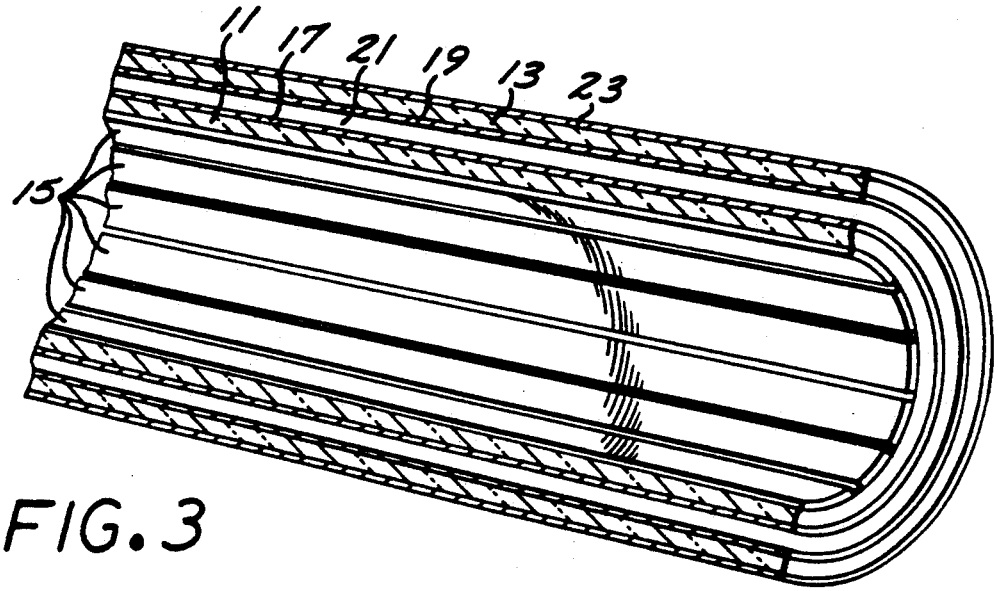
FIG. 3

GEOMETRY ENHANCED OPTICAL OUTPUT FOR RF EXCITED FLUORESCENT LIGHTS

BACKGROUND OF THE INVENTION

The disclosed invention is directed generally to fluorescent light structures, and is directed more particularly to a fluorescent light structure that is configured to reduce the light attenuating effects of the phosphor coating which produces the visible light.

The prior art consists of conventional fluorescent light tubes. These use a glow discharge to generate ultraviolet (UV) light from a low pressure gas. As shown in FIG. 1, the gas is contained in a sealed tube whose interior surface is coated with a phosphor. The UV light excites the phosphor atoms which then emit visible light as they return to lower energy states. Although the phosphor is thin, it attenuates the optical output from the phosphor atoms except those at the interior surface of the tube. It also attenuates the UV which energizes the phosphor. The result is that the light intensity is highest on the inside of the tube where it is useless with the light reaching the outside heavily attenuated.

SUMMARY OF THE INVENTION

The purpose of the invention is to significantly increase the efficiency (light output/electrical input power) of conventional fluorescent light tubes by modifying the structure to minimize the light attenuating effects of the phosphor coating by exposing the outer surface of the phosphor to the gas discharge produced UV. The total efficiency improvement may be as high as a factor of 5. The reduced electrical power requirements require a smaller, lower cost ballast. Further, since much less electrical power is utilized, the effects on electrical power factor and total harmonic distortion are reduced, making it easier to meet increasingly stringent governmental regulations.

The foregoing and other advantages are provided by the invention in a fluorescent lighting structure that includes encloses the inner glass container, an ionizable gas contained in the volume between the inner and outer glass containers, an electrode structure disposed on the inside surface of the inner glass container, and a phosphor coating disposed on the outside surface of the inner glass container. Excitation of the electrode structure causes discharge of the ionizable gas that produces ultraviolet (UV) radiation, which in turn excites the phosphor coating include a UV reflective coating on the inside surface of the outer glass container. By way of specific examples, the inner and outer glass containers comprise concentric glass tubes or glass bulbs.

BRIEF DESCRIPTION OF THE DRAWINGS

The advantages and features of the disclosed invention will readily be appreciated by persons skilled in the art from the following detailed description when read in conjunction with the drawing wherein:

FIG. 1 is a schematic sectional illustration of a typical prior art fluorescent lighting structure.

FIGS. 2 and 3 are schematic sectional illustrations of a fluorescent lighting structure in accordance with the invention.

DETAILED DESCRIPTION OF THE DISCLOSURE

Figure 4:
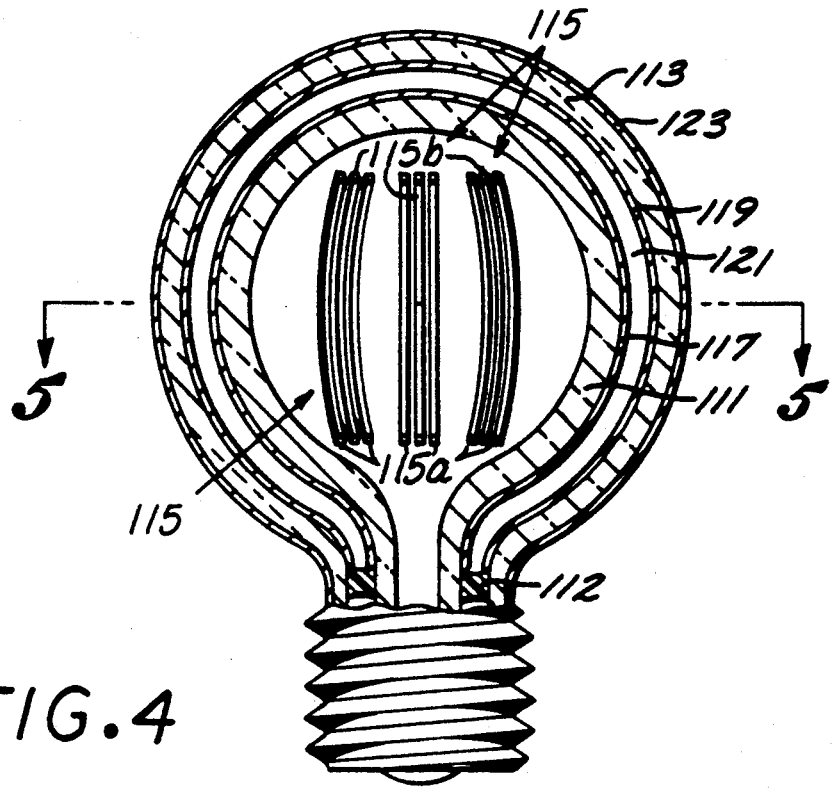
FIGS. 4 and 5 are schematic sectional illustrations a further fluorescent lighting structure in accordance with the invention.

In the following detailed description and in the several figures of the drawing, like elements are identified with like reference numerals.

The desired mode of operation for a fluorescent light is to have the same surface of the phosphor that is exposed to the ultraviolet (UV) radiation from the discharge also be the one that is directly exposed to the outside environment (i.e., the area to be lighted). This invention produces this condition by utilizing internal electrodes in conjunction with an inside-out geometric structure. Fluorescent lights come in a variety of sizes and shapes. The invention is described for implementation in one of the most common applications, a tube structure such as could be used in 4 or 8 foot applications. However, the principles and structure relationships can be achieved in almost any lamp overall geometry.

Referring now to FIGS. 2 and 3, schematically depicted therein by way of illustrative example is a fluorescent lighting structure which includes an inner cylindrical glass tube 11 and an outer cylindrical glass tube 13 which is concentric with and surrounds the inner glass tube.

An electrode structure 15 is disposed on the inside surface of the inner glass tube 11, and a phosphor layer 17 is disposed on the outer surface of the inner cylinder 11. A ultraviolet (UV) reflective coating 19 that is transparent to visible light is disposed on the inside of the outer glass tube 13, and an optically transparent conductive coating 23 is disposed on the outside of the outer tube 13. For considerations such as simplification of manufacture and cost reduction, the UV reflection coating may be omitted.

The ends of the tubes are appropriately sealed so as to seal the region 21 between the cylinder glass tubes which forms a discharge region and contains a low pressure gas. Preferably, the electrode structure 15 and connections thereto are outside the discharge region 21 and the ends of the tubes are sealed by a glass to glass process, so as to minimize leakage and maximize lamp life. The volume of the discharge region is made as small as practicable consistent with electrode and overall light output requirements, which allows the phosphor area to be only slightly smaller than conventional fluorescent tubes for the same outer lamp diameter.

The electrode structure 15 is driven with an RF source and produce an electromagnetic field which penetrates the inner glass tube and the phosphor coating to induce a controlled breakdown and discharge of the gas in the discharge region 21, with the highest intensity being directly adjacent the phosphor coating. Depending upon the particular implementation, the RF source as well as other appropriate RF circuits can be located inside the inner glass tube 11.

The UV reflection coating reflects UV light emitted away from the phosphor coating back towards the phosphor coating. This increases the electrical to UV efficiency by a factor of about 2. The outer glass tube 13 is preferably transparent to visible light but opaque to UV to minimize UV emissions.

The optically transparent electrically conductive coating 23 provides shielding to minimize RF radiation and resulting EMI, and is preferably configured to be an effective attenuator of RF radiation from the fundamental operating frequency of the RF source out through the 7 th harmonic at a minimum. The outer glass tube of the lamp could perform this function instead of the coating if the glass is configured to have the electrical/RF characteristics for performing the shielding function.

Figure 5:
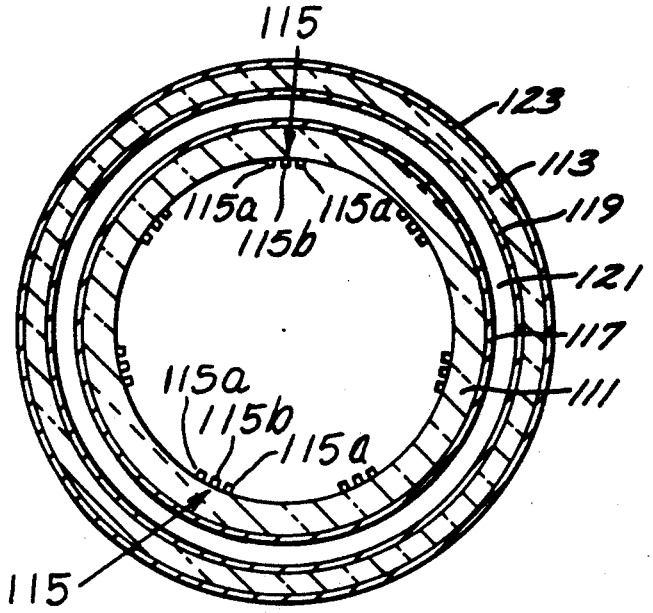

Referring now to FIGS. 4 and 5, schematically depicted therein by way of illustrative example is a fluorescent lighting structure which includes an inner bulb shaped glass envelope 111 and an outer bulb shaped glass envelope 113 which is shaped similarly to the inner glass envelope and surrounds the inner glass envelope.

Electrode structures 115 distributed on the inside surface of the inner glass envelope 111 and a phosphor layer 117 is disposed on the outer surface of the inner glass envelope 111. A ultraviolet (UV) reflective coating 119 that is optically transparent to visible light is disposed on the inside surface of the outer glass envelope 113, and an optically transparent conductive coating 123 is disposed on the outside surface of the outer glass envelope 113.

A glass seal 112 is located in the stem portions of the bulb shaped glass envelopes to seal the region 121 between the bulb shaped glass envelopes which forms a discharge region and contains a low pressure gas. The electrode structure 115 and connections thereto are outside the discharge region 21, which minimizes leakage and maximizes lamp life. The volume of the discharge region is made a small as practicable consistent with electrode and overall light output requirements.

Each of the electrode structures 115 includes interconnected outer ground electrodes 115*a* and a central power electrode 115*b* which generally extend from the upper portion to the lower portion of the bulb shaped envelope. The electrode structures are appropriately driven by respective matching networks responsive to respective outputs of a splitter circuit connected to an RF source.

The electrode structures 115 produce respective electromagnetic fields which penetrate the inner glass envelope and the phosphor coating to induce a controlled breakdown and discharge of the gas in the discharge region 121, with the highest intensity being directly adjacent the phosphor coating. Depending upon the particular implementation, the RF source, splitter circuit, and matching networks can be located inside the inner glass envelope 111.

The UV reflection coating reflects UV light emitted away from the phosphor coating back towards the phosphor coating, which increases the electrical to UV efficiency. The outer glass envelope 113 is preferably transparent to visible light but opaque to UV to minimize UV emissions.

The optically transparent electrically conductive coating 21 provides shielding to minimize RF radiation and resulting EMI, and is preferably configured to be an effective attenuator of RF radiation from the fundamental operating frequency of the RF source out through the 7 th harmonic at a minimum. The outer glass envelope of the lamp could perform this function instead of the coating if the glass is configured to have the electrical/RF characteristics for performing the shielding function.

It should be appreciated that in accordance with the invention, a bulb shaped outer glass envelope can be utilized with a cylindrical inner glass tube similar to the inner glass tube 11 of the lighting structure shown in FIGS. 2 and 3, which would provide for a simpler electrode structure.

Although the foregoing has been a description and illustration of specific embodiments of the invention, various modifications and changes thereto can be made by persons skilled in the art without departing from the scope and spirit of the invention as defined by the following claims.

What is claimed is:

1. A fluorescent lighting structure comprising:

a first glass container having an inside surface and an outside surface;

a second glass container having an inside surface and an outside surface, said second glass container surrounding and spaced from said first glass container so as to define a sealed volume therebetween and so as to have the inside surface of said second glass container facing the outside surface of said first glass container;

an ionizable gas contained within the volume between said first and second glass containers;

an RF electrode structure disposed exclusively on the inside surface of said first glass container; and a light emitting coating that emits light in response to ultraviolet radiation disposed exclusively on the outside surface of said first glass container, said second glass container being devoid of any light emitting coating on either of its surfaces;

whereby contiguous excitation of said electrode structure with RF energy causes discharge of said ionizable gas that produces ultraviolet radiation, which in turn excites the light emitting coating to emit visible light.

2. The fluorescent lighting structure of claim 1 wherein said first and second glass containers comprise first and second concentric glass tubes.

3. The fluorescent lighting structure of claim 1 further including an ultraviolet reflection coating disposed on the inside surface of said second glass container.

4. The fluorescent lighting structure of claim 1 wherein said first and second glass containers comprise bulb shaped glass envelopes.

* * * * *